US010159349B1

(12) United States Patent
Frankel et al.

(10) Patent No.: US 10,159,349 B1
(45) Date of Patent: Dec. 25, 2018

(54) FOLDING SOFA

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 15/678,706

(22) Filed: Aug. 16, 2017

(51) Int. Cl.

| | |
|---|---|
| ***A47C 4/28*** | (2006.01) |
| ***A47C 4/38*** | (2006.01) |
| ***A47C 4/42*** | (2006.01) |
| ***A47C 4/48*** | (2006.01) |
| ***A47C 4/32*** | (2006.01) |

(52) U.S. Cl.
CPC . *A47C 4/42* (2013.01); *A47C 4/32* (2013.01)

(58) Field of Classification Search
CPC ..... A47C 4/32; A47C 4/42
USPC ..... 297/28, 45, 52, 55, 56
See application file for complete search history.

(56) References Cited

U.S. PATENT DOCUMENTS

| | | | | | |
|---|---|---|---|---|---|
| 104,398 | A * | 6/1870 | Adams | A47C 1/0265 | 297/28 |
| 155,758 | A * | 10/1874 | Schlientz | A47C 1/0265 | 297/28 |
| 376,256 | A * | 1/1888 | Parks | A47C 1/0265 | 297/28 |
| 383,058 | A * | 5/1888 | Kree | A47C 1/0265 | 297/28 |
| 1,694,933 | A * | 12/1928 | Walker | A47C 4/40 | 297/56 X |
| 2,741,298 | A * | 4/1956 | Roberts, III | A47C 4/40 | 297/56 X |
| 2,787,316 | A * | 4/1957 | Moore | A47C 4/48 | 297/56 X |
| 7,000,983 | B1 * | 2/2006 | Tsai | A47C 4/50 | 297/56 |
| 8,025,332 | B2 * | 9/2011 | Tsonev | A47C 7/70 | 297/55 X |
| 2004/0017098 | A1 * | 1/2004 | St. Germain | A47C 3/0255 | 297/56 X |
| 2004/0245810 | A1 * | 12/2004 | Tseng | A47C 4/50 | 297/56 |
| 2006/0232108 | A1 * | 10/2006 | Hsieh | A47C 5/06 | 297/45 |
| 2011/0037297 | A1 * | 2/2011 | Lo | A47D 1/008 | 297/56 X |
| 2016/0113402 | A1 * | 4/2016 | Lee | A47C 4/42 | 297/16.2 |
| 2016/0113403 | A1 * | 4/2016 | Lee | A47C 4/42 | 297/16.2 |

(Continued)

*Primary Examiner* — Rodney B White
(74) *Attorney, Agent, or Firm* — Merek, Blackmon & Voorhees, LLC

(57) ABSTRACT

A folding sofa that includes symmetrical armrest bars on both sides, front support bars and rear support bars, as well as a fabric seat. The armrest bar consists of a curved U-shaped bar with a symmetrical armrest section and U-shaped portion. The armrest section is formed in a wave shape that starts low in the front and rises high in the rear, with the front lower portion also being attached to an armrest auxiliary bar to provide support for resting the forearms. The rear support bars, after hinging to the armrest bars, have extended sections protruding forward to support the front edge of the fabric seat cushion.

14 Claims, 7 Drawing Sheets

(56) References Cited

U.S. PATENT DOCUMENTS

| | | | | |
|---|---|---|---|---|
| 2016/0135601 | A1* | 5/2016 | Curren | A47C 3/00<br>297/451.9 |
| 2017/0311723 | A1* | 11/2017 | Lenhart | A47C 4/286 |
| 2018/0035806 | A1* | 2/2018 | Yang | A47C 4/42 |

* cited by examiner

FOLDING SOFA

BACKGROUND OF THE INVENTION

Field of the Invention

This invention falls under the field of furniture, and specifically consists of a type of foldable sofa with the unique characteristic of providing full support for the forearms.

Technical Background

Existing folding round chairs, perhaps more commonly known as crescent seats or radar seats, are manufactured with soft fabric and bars. The chair cushion area is round when viewed from the front, and the chair tilts forward to form a radar-like shape. From the side, the chair also seems to have the shape of a half-moon, which is why it is sometimes called a crescent seat. Its simple structure and unique look gave rise to its huge popularity. As shown FIG. 1, its structure includes a round seat hoop (20), a fabric seat (2) that is fitted over the seat hoop (20), and the front/rear support bars (3 & 4) that support the seat hoop (20) on both sides. The front/rear support bars (3 & 4) cross each other, and the top part of each bar hinges onto the seat hoop (20). The hinge on the front support bar (3) has a slide housing (5); the rear support bar (4) passes through the slide housing (5), thus forming a movable hinged structure between the front/rear support bars (3 & 4). For that purpose, the rear support bar (4) has a slide stop (6), so that the slide housing (5) is supported when the round chair is unfolded to the open position. Additionally, each of the two front support bars (3) and the two rear support bars (4) on both sides are connected together with a curved bar. The folding round chair has a simple structure and an innovative shape as some of its special features. However, sitting in the chair results in a significant amount of pressure on the thighs when resting on the front part of the hoop. Moreover, even though both hands can be placed on the hoop, there is no good support on the surface of the tilted hoop, which results in user's two forearms sliding down the chair. In this regard, the chair provides poor support. An objective of this invention is to improve the flaws of the existing chair, and design a folding sofa that would provide more comfort to the user in a seated position.

SUMMARY OF THE INVENTION

A purpose of this invention is to provide a type folding sofa with armrest bars that make use of curved U-shaped bars, with the lower front portion curving upward in a wavelike shape towards the rear portion to allow for support for the user's forearms. A secondary purpose is to place stronger horizontal supports on the two sides of the front support bars.

The technical plan of this invention is accomplished in part as follows:

A type of folding sofa that includes:

Armrest bars with corresponding hinges on the upper portions of the two front and rear support bars;

A fabric seat fitted onto the handrail bars;

Front support bars with the corresponding hinges on the upper portions of the two front support bars being fitted with a slide housing;

Rear support bars, with each of the two rear support bars passing through the slide housing on each corresponding side, thus forming a movable hinge structure combining the front and rear support bars;

Each of the rear support bars is fitted with a slide stop. When the sofa is in the open position, the slide housing rests against the slide stop, which provides support and stability for the chair;

The two aforementioned front support bars are one interconnected structure as are the two rear support bars.

The invention preferably has one or more the following special features:

The aforementioned armrest bar is a curved U-shaped bar, which also has a corresponding armrest section and a U-shaped portion;

The aforementioned armrest sections are formed in a wave shape that flows upward from the front to the rear and with the wave-shaped portions particularly positioned in the areas where the forearms rest.

The front-half portion of the armrest section is also connected to an armrest auxiliary bar, which is formed in a wave shape similar to the armrest section.

The aforementioned rear support bars, after hinging onto the armrest bars, have extended sections that protrude forward;

The aforementioned fabric seat consists of an integrated cushion, backrest, and armrests;

The upper portion of the backrest is fitted onto the U-shaped portion connecting both sides of the armrest sections. The upper portion of each armrest is fitted onto both the armrest section and the armrest auxiliary bar. Both sides of the cushion are suspended on the aforementioned extended sections of the rear support bars.

The aforementioned armrest auxiliary bars are located on the inner side of each of the armrest bars. The armrest auxiliary bars are hinged at the same point where both the armrest bar and front support bar connect as well as where the armrest bar and rear support bar connect. The aforementioned hinges are attached with long rivets, and the exposed parts of the rivets are covered with sheaths.

The two aforementioned front support bars connect to the main frame as follows: Each front support bar is hinged with a slide housing on the upper ends, and the horizontal bar assembly is positioned to strengthen the support bars on both sides.

The aforementioned horizontal bar assembly consists of the following structure:

1. The horizontal bar assembly includes a short U-shaped bar and a curved section that connects to the two ends of the short U-shaped bar. This is affixed firmly to the front support bars and is secured firmly to the structure with rivets.
2. The horizontal bar assembly also consists of the main horizontal bar and a protective sheath, with the vertical convex portion of the sheath being fitted with a bar casing; the protective sheath is positioned on the front support bars, and each end of the horizontal bars are inserted into the bar casings of the sheaths on each side, thus forming a connected structure.

The two curved sections of the aforementioned short U-shaped bars affix closely to the front or inner sides of the front support bars on both sides and are riveted together.

The two aforementioned front support bars are independent bars or are formed by bending a single U-shaped bar.

The aforementioned rear support bars are connected to the entire structure as described below:

1. A U-shaped bar formed by curving a single bar;

2. Independent bars, which are formed by soldering two ends of a single bar to the rear support bars, thereby connecting into an integrated structure.
3. Independent bars, which are formed by riveting the two curved sections of the short U-shaped bars to the support bars, thereby connecting into an integrated structure.

The distance between the top ends of each of the aforementioned front support bars and the hinged points of the slide housings is between 10 cm and 25 cm inclusive.

The aforementioned fabric seat is constructed by stitching the cushion, backrest, and armrests together into one complete unit, which is attached to the cushion U-shaped bar.

This invention uniquely designs the front portions of the armrest bars into wave-shapes that curve upward. Once the sofa is opened, it provides the needed support for the forearms, thereby providing support and comfort to the seated user. The two rear support bars serve a tightening role for the front portion of the fabric seat cushion, while the rear portion, including the armrest and backrest, are fitted onto the armrest bar, thus providing a comfortable support for the buttocks and preventing any unwanted sliding forward. The overall structure is universal and innovative. It can be folded for storage and shipment and is characterized best by its seating comfort.

BRIEF DESCRIPTION OF THE DRAWINGS

Similar reference characters denote corresponding features consistently throughout the attached drawings. Namely, in the drawings the following reference numbers refer to the following part.

1—armrest bar
11—armrest section
12—U-shaped portion—U
13—armrest auxiliary bar
2—fabric seat material,
20—seat hoop
21—cushion
211—cushion U-shaped bar cushion,
22—backrest back
23—arm rest
3—front support bar
4—rear support bar
41—extended section paragraph
42—bar
5—slide housing
<g6—slide stop;/g>
7—long rivet—
71—sheath
8—horizontal bar assembly—
81—short U-shaped bar short
811—curved section
82—horizontal bar crossbar
83—protective sheath.
831—bar casing

DETAILED DESCRIPTION OF THE PREFERRED EMBODIMENT(S)

Figure 1:
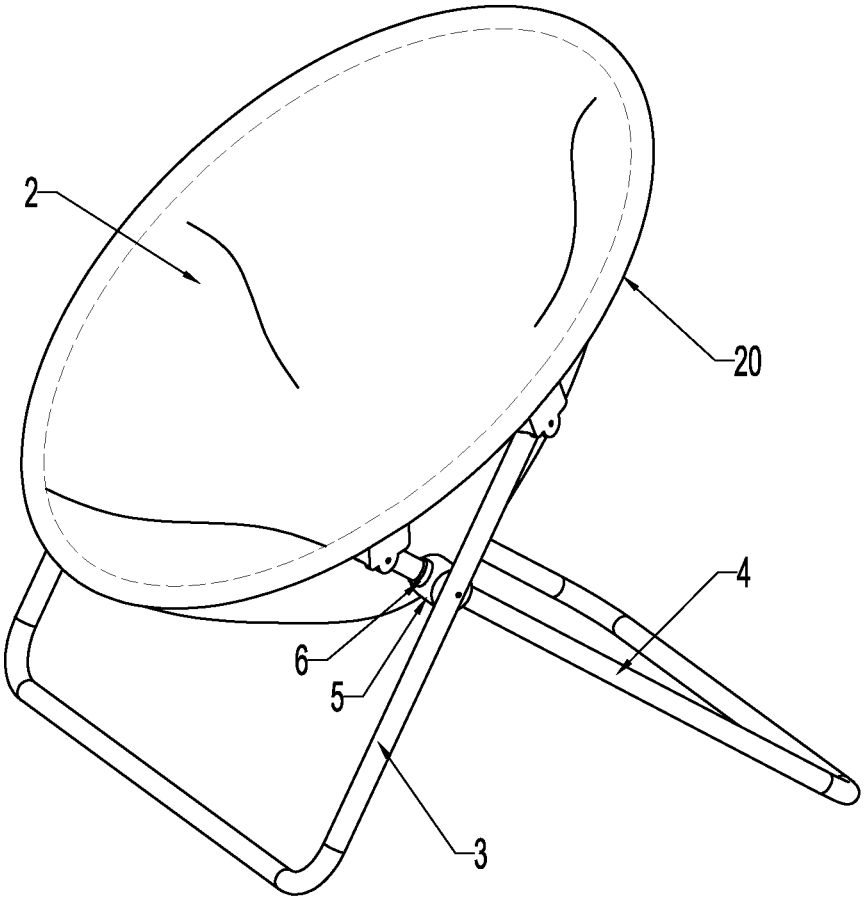
FIG. 1 PRIOR ART
FIG. 1 provides a 3D diagram of an existing, prior art folding round chair.
Figure 2:
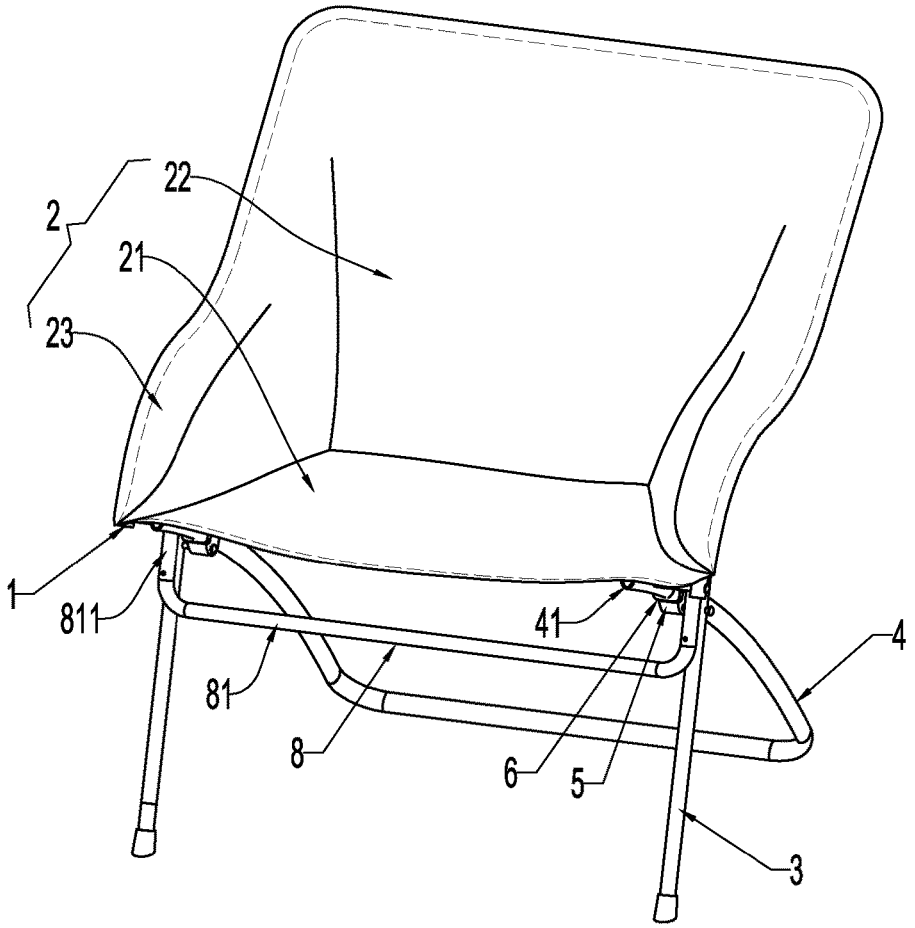
FIG. 2 provides a 3D diagram of a folding sofa
Figure 3:
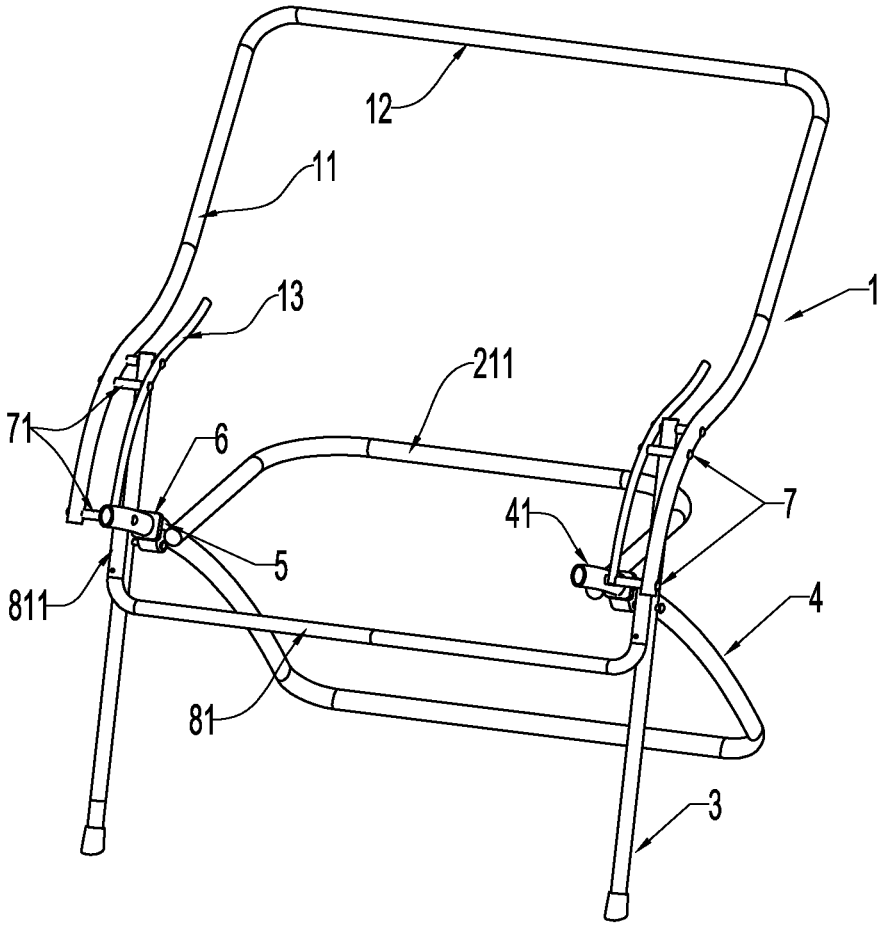
FIG. 3 provides a 3D diagram of folding sofa frame
Figure 4:
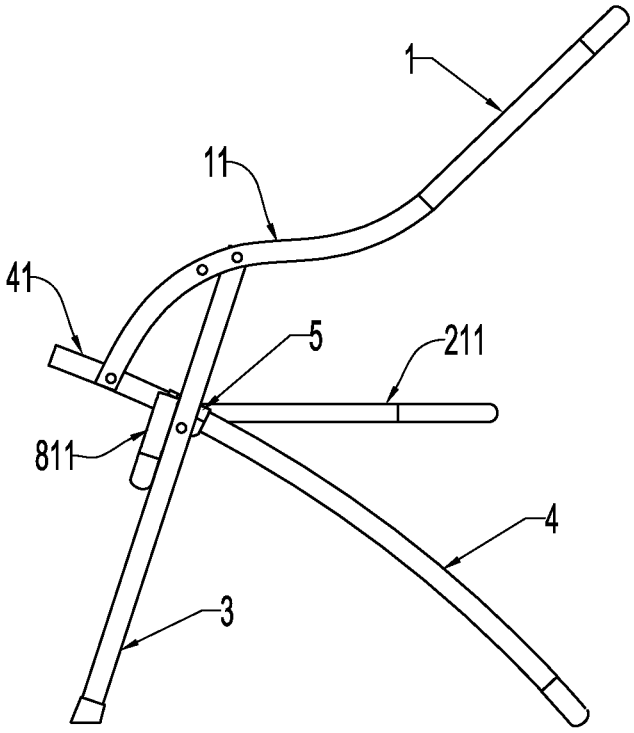
FIG. 4 provides the side view of the folding sofa frame

As shown in FIGS. 2-4, the folding sofa includes: armrest bars (1), fabric seat (2), front support bars (3) and rear support bars (4). The front support bars (3) have a slide housing (5) on corresponding positions on the upper parts of the front support bars (3) on both sides. The two rear support bars (4) pass through the slide housing (5) on the corresponding sides, thereby forming a moveable hinged structure for the front and back support bars (3 &4). The slide stop (6) is positioned towards the upper end of the rear support bar (4), which provides stability as the slide housing (5) to rests against the slide stop (6) when the sofa is in the opened position and limits the angle by which the chair can be opened.

The armrest (1) is a curved U-shaped bar with a corresponding armrest section (11) and U-shaped portion (12). The armrest section (11) is formed in a wave-shape that starts low in the front and rises high to the rear, with the actual waved section being positioned at the point where the forearms rest. The front half of armrest section is riveted to armrest auxiliary bar (13), which combined with the parallel armrest section (11), forms a widened wave-shaped structure providing support to the forearms. The armrest bar (1) is hinged to the top ends of the front and rear support bars (3 & 4) on both sides by means of the two armrest sections (11). More specifically, the armrest auxiliary bar (13) is positioned on the inner side of the armrest section (11), while the armrest auxiliary bar (13) is hinged at the same hinge where the armrest bar (1) and front support bar (3) are connected and where armrest bar (1) the rear support bar (4) are connected. The hinge point is preferably riveted with a long rivet (7). The exposed section of the long rivet (7) is covered with a sheath (71) which also helps to maintain a constant distance between the two parts.

To ensure the front portion of the armrest bar (1) is at a sufficient height, the distance between the hinge point of slide housing (5) and the top end of front support bar (3) should be between 10 cm to 25 cm. As a result, when the armrest bar (1) is raised upwardly, both forearms are able to rest comfortably, and there is adequate room in the backrest area.

Once the rear support bar (4) and armrest bar (1) are hinged, an extended section (41) is formed protruding forward. The fabric seat (2) is composed of a cushion (21), backrest (22) and armrest (23). The backrest (22) has a hood that fits over the U-shaped portion (12) of the armrest bar. A separate hood for armrest (23) is fitted over the armrest section (11) and armrest auxiliary bar (13). The two sides of the cushion (21) are suspended on the front of the extended section (41) of the rear support bar (4), thus forming a relatively stiff support. The other three edges of the cushion (21) are connected to the two armrests (23) and backrest (22), which forms a soft suspension that prevents sliding forward while sitting.

The two front bars (3) are one connected structure ("unitary"), as are the two rear bars (4). This results in the formation of a stable and supported sofa structure, more specifics of which are described as follows:

Both sides of the front support bar (3) connect to the overall structure as follows: on the hinged portion of the front support bar (3) there is a slide housing (5), which is connected to the horizontal bar assembly (8) providing reinforcement for the structure. This horizontal bar assembly (8) is constructed in the following manner:

1. As shown in FIGS. 2-4, the horizontal bar assembly (8) includes a short U-shaped bar (81). Leveraging the curved section (811) of the two ends of the short U-shaped bar (81) allows it to stay close to the front support bars (3), and it is formed into a fixed structure by means of rivets. Specifically, the two curved sections (811) of the short U-shaped bar (81) stay close to the front or inner surface of the front support bars on both sides, forming the two best hinge positions. This provides strength and protection to the receiving point of the front support bars (3) and prevents the sofa from collapsing due to body weight. It also improves the strength and capacity of the area around the rivet point of slide housing (5). 2. As shown in the figures, the two front support bars (3) are independently situated. This allows for them to remain stable on the floor and minimize the possibility of the chair overturning.

Figure 5:
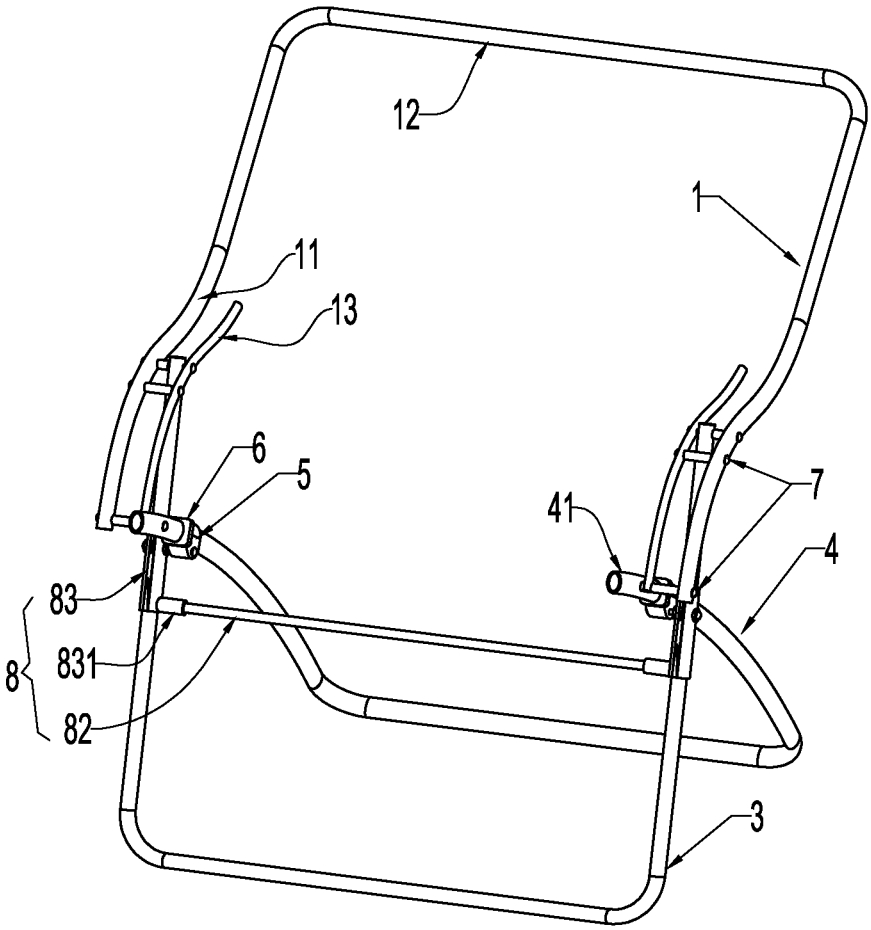
FIG. 5 provides a 3D diagram of the folding sofa frame 2.
Figure 6:
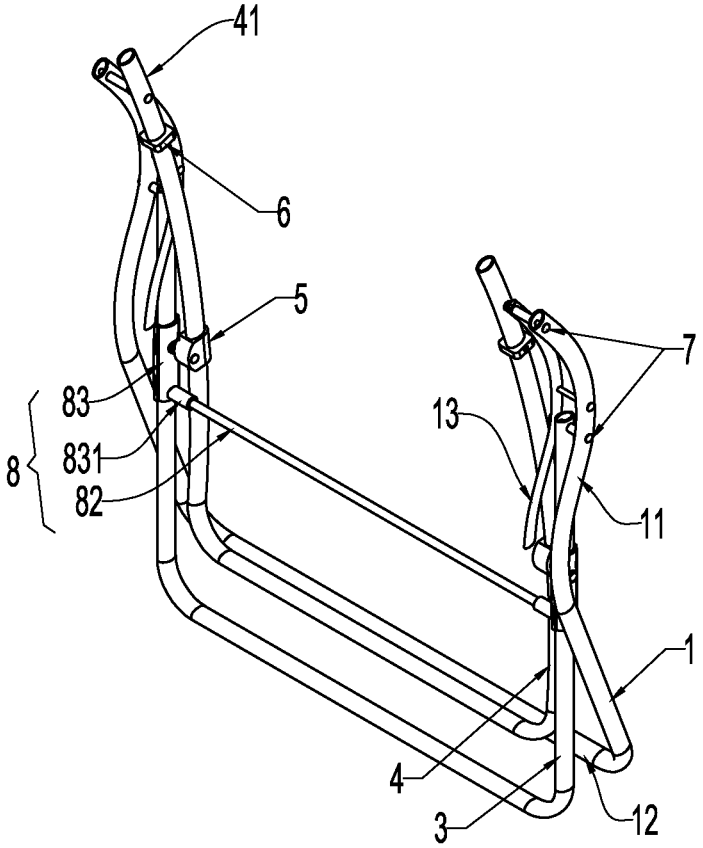
FIG. 6 is a schematic view of the folding sofa frame in a collapsed position.

As shown in FIGS. 5 and 6, the horizontal bar assembly (8) consists of the horizontal bar (82) and the protective sheath (83). The vertical convex portion of the protective sheath (83) has a bar casing (831). The protective sheath (83) is positioned on the front support bars (3), and the two ends of the horizontal bar (82) are inserted into the bar casings (831) of the sheath on the both sides, thus preventing the bars on both sides from collapsing due to weight. In the figures, the support bar (3) is shown formed by bending a single U-shaped bar to improve the connection and integrity of the two sides.

Figure 7:
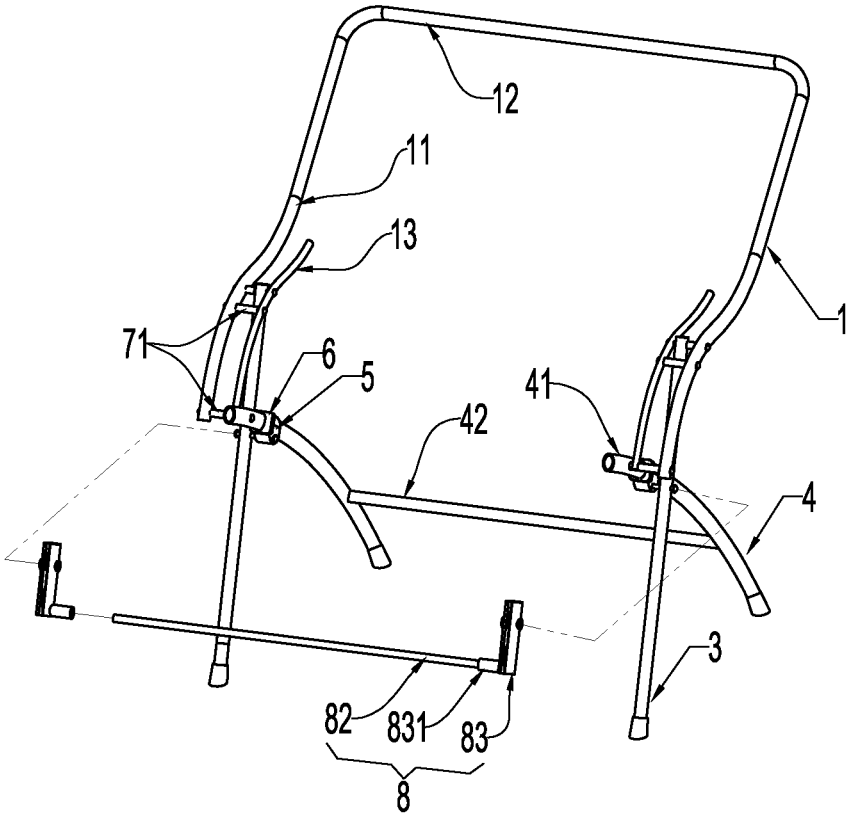
FIG. 7 provides a diagram of a broken down folding sofa frame 3.

The interconnected structure formed by the rear support bars (4) on both sides is constructed as follows:

1. As shown in FIGS. 2 and 3, a U-shaped bar is formed by curving a single bar;

2. As shown in FIG. 7, independent bars are also used by soldering two ends of a single bar to the rear support bars, thereby connecting into an integrated structure;

3. Independent bars, formed by 3. Independent bars are also utilized by riveting two curved sections of a short U-shaped bar to the support bar, thus connecting into an integrated structure; FIG. 3 demonstrates that the same formation can occur with the front support bars.

Referring now to FIGS. 2, 3, and 4, to prevent the fabric seat (2) and especially the cushion (21) from excessive deformation due to the application of weight, a cushion U-shaped bar (211) is positioned where the fabric seat sits on the seam areas connecting the cushion (21), backrest (22) and both armrests (23). The cushion U-shaped bar (211) helps not only to maintain the cushion's (21) shape but also promote a relatively courteous/comfortable seating posture.

Also, as per FIGS. 2 and 4, a type of independent front support bar (3) is provided to form a strong connection on both sides by leveraging the horizontal bar component or short U-shaped bar (81). The rear support bar (4) is a bar that is curved into a U-shaped structure. Along with the cushion U-shaped bar (211), the fabric seat (2) can be opened to a better shape with firmer seating support. Therefore, this is the preferable design solution of choice. As shown in FIGS. 5 and 6, describing the second configuration, the front/rear support bars (3 & 4) both employ a single bar that curves into a U-shaped structure. This maximizes the ground contact area and makes it more appropriate for outdoor use. The matching horizontal bar assembly (8), which is formed by the horizontal bar (82) and protective sheath (83), has a simple structure. FIG. 7 shows the front and rear support bars (3 & 4) formed by independent bars. The two rear support bars (4) are soldered onto an independent horizontal bar (42). This is the simplest method which also allows the slide housing (5) to have the maximum sliding range. This design allows all four legs to touch the floor and promotes a traditional sofa feel. Both configurations are shown to include the cushion U-shaped bar (211), as would any other combinations.

We claim:

1. A folding sofa that includes: a pair of front support bars pivotably, connected to a pair of rear support bars and to a pair of arm rest bars;

a pair of upper hinges, a pair of lower hinges, and a pair of front hinges;

each of said pair of armrest bars (1) is hinged by a respective upper hinge onto an upper portion of a respective one of said pair of front support bars (3) and is hinged onto an upper portion of a respective one of said rear support bars (4) by a respective front hinge;

a fabric seat (2) affixed between the pair of armrest bars (1);

each of said front support bars (3) has a slide housing (5) connected thereon by a respective one of said lower hinges to slidingly receive a respective one of said rear support bars within said slide housing;

said rear support bars (4), each of which passes through the slide housing (5) on a corresponding side of the sofa, thereby forming a movable lower hinge structure connecting the front support bars (3) and rear support bars (4);

a pair of slide stops (6) positioned on the upper portions of the rear support bars (4), whereby when the sofa is unfolded into an open position, the slide housings (5) rest against the slide stops (6) to prevent further relative motion between the front support bar and the rear support bar;

said two front support bars (3) each connected at a lower end thereof by a front support U-shaped bar;

said two rear support bars (4) each connected at a lower end thereof by a rear support U-shaped bar;

said armrest bars (1) are connected to each other by a pair of armrest sections and a U-shaped portion to form a seat frame;

said armrest bars and arm rest sections form a wave shape, with the lower front portion curving upward in a wave-shape towards the rear portion; and a front portion of the armrest section (11) connected to an armrest auxiliary bar (13), which is formed in a wave shape.

2. The folding sofa of claim 1, wherein the rear support bars (4) each further include an extended section (41) that protrudes above and in front of the slide housing.

3. The folding sofa of claim 1, wherein the fabric seat (2) includes an integrated cushion (21), a backrest (22), and two armrests (23);

wherein an upper portion of each armrest (23) is fitted onto both the armrest sections (11) and the armrest auxiliary bar (13);

and wherein two sides of the cushion (21) are suspended on the extended sections (41) of the rear support bars.

4. The folding sofa of claim 3, wherein the fabric seat is constructed by stitching the cushion (21), backrest (22), and armrests (23) together into one complete unit, which is attached to a cushion U-shaped bar (211).

5. The folding sofa of claim 1, wherein the armrest auxiliary bars (13) are located on inward sides of each of said armrest bars (1) and said armrest sections (11);

each of said armrest auxiliary bars (13) is hinged to a respective armrest bar (1) and a respective front support bar (3) by a respective upper hinge; and each of said armrest auxiliary bars (13) is hinged to a respective armrest bar (1) and a respective rear support bar (4) by a respective front hinge.

6. The folding sofa of claim 5, wherein said upper hinges and said front hinges include long rivets (7) covered with sheaths (71).

7. The folding sofa of claim 1, further including a horizontal bar assembly (8) that includes a U-shaped bar (81) having two ends, and a curved section (811) that connects to both ends of the U-shaped bar (81); and said curved section (811) is connected to the front support bars (3) by rivets.

8. The folding sofa of claim 7, wherein the two curved sections (811) of the U-shaped bars are affixed closely to front or inner sides of the front support bars (3) on both sides and are riveted together.

9. The folding sofa of claim 1, having a horizontal bar assembly (8) that includes a main horizontal bar (82) and a protective sheath (83), wherein a vertical con vex portion of the sheath (83) is fitted with a bar casing (831); and the protective sheath (83) is positioned on said front support bars (3), and each end of the horizontal bar (82) is inserted into a bar casing (831) of the sheath on each side to form a connected structure.

10. The folding sofa of claim 1, wherein the two front support bars (3) are formed by bending a single U-shaped bar.

11. The folding sofa of claim 1, wherein said rear support bars (4) are formed in a continuous U-shape by curving a single bar.

12. The folding sofa of claim 1, wherein the distance between top ends of each of the front support bars (3) and hinged points of the slide housings (5) is between 10 cm and 25 cm.

13. The folding sofa of claim 1, wherein said rear support bars (4) are parallel to each other and are connected to each by soldering two ends of a single bar (42) to each of the rear support bars (4).

14. The folding sofa of claim 1, wherein said rear support bars (4) are parallel to each other and are connected to each by riveting two curved sections of a U-shaped bar to the rear support bars to form a rear U-shaped section.

* * * * *